US006405555B1

(12) United States Patent
Rowland et al.

(10) Patent No.: US 6,405,555 B1
(45) Date of Patent: Jun. 18, 2002

(54) METHOD AND APPARATUS FOR THE COOLING OF BULK OR DRAUGHT BEVERAGES

(75) Inventors: John Stafford Rowland, Hope Valley; Douglas Richard Leeming, Chesterfield; Brian John Colin Brown, Eastleigh, all of (GB)

(73) Assignee: Eventemp Limited, Chesterfield (GB)

( * ) Notice: Subject to any disclaimer, the term of this patent is extended or adjusted under 35 U.S.C. 154(b) by 0 days.

(21) Appl. No.: 09/453,427

(22) Filed: Dec. 2, 1999

(30) Foreign Application Priority Data

Dec. 4, 1998 (GB) ..... 9826685

(51) Int. Cl.[7] ..... B67D 5/62

(52) U.S. Cl. ..... 62/390; 62/389; 62/393; 62/394; 62/395

(58) Field of Search ..... 62/389, 390, 393, 62/394, 395

(56) References Cited

U.S. PATENT DOCUMENTS 2,622,851 A * 12/1952 Minor ..... 62/395
2,625,804 A * 1/1953 Patch et al. ..... 62/395
3,280,587 A * 10/1966 Booth et al. ..... 62/395
3,312,083 A * 4/1967 Scoggins et al. ..... 62/395
4,009,593 A * 3/1977 Davis ..... 62/250
4,216,879 A 8/1980 McMillin
4,377,076 A * 3/1983 Staudt et al. ..... 62/395
5,319,947 A * 6/1994 Fischer ..... 62/389
5,535,600 A * 7/1996 Mills ..... 62/390
5,743,108 A * 4/1998 Cleland ..... 62/393
5,950,866 A * 9/1999 Lancaster ..... 222/1
5,974,824 A * 11/1999 Galockin et al. ..... 62/394

FOREIGN PATENT DOCUMENTS

WO WO 97/28082 8/1997 ..... B67D/1/08

* cited by examiner

*Primary Examiner*—William Doerrler
*Assistant Examiner*—Mark Shulman
(74) *Attorney, Agent, or Firm*—Fish & Richardson P.C.

(57) ABSTRACT

A method of cooling bulk or draught beverages prior to dispensing comprising:

Figure 1:
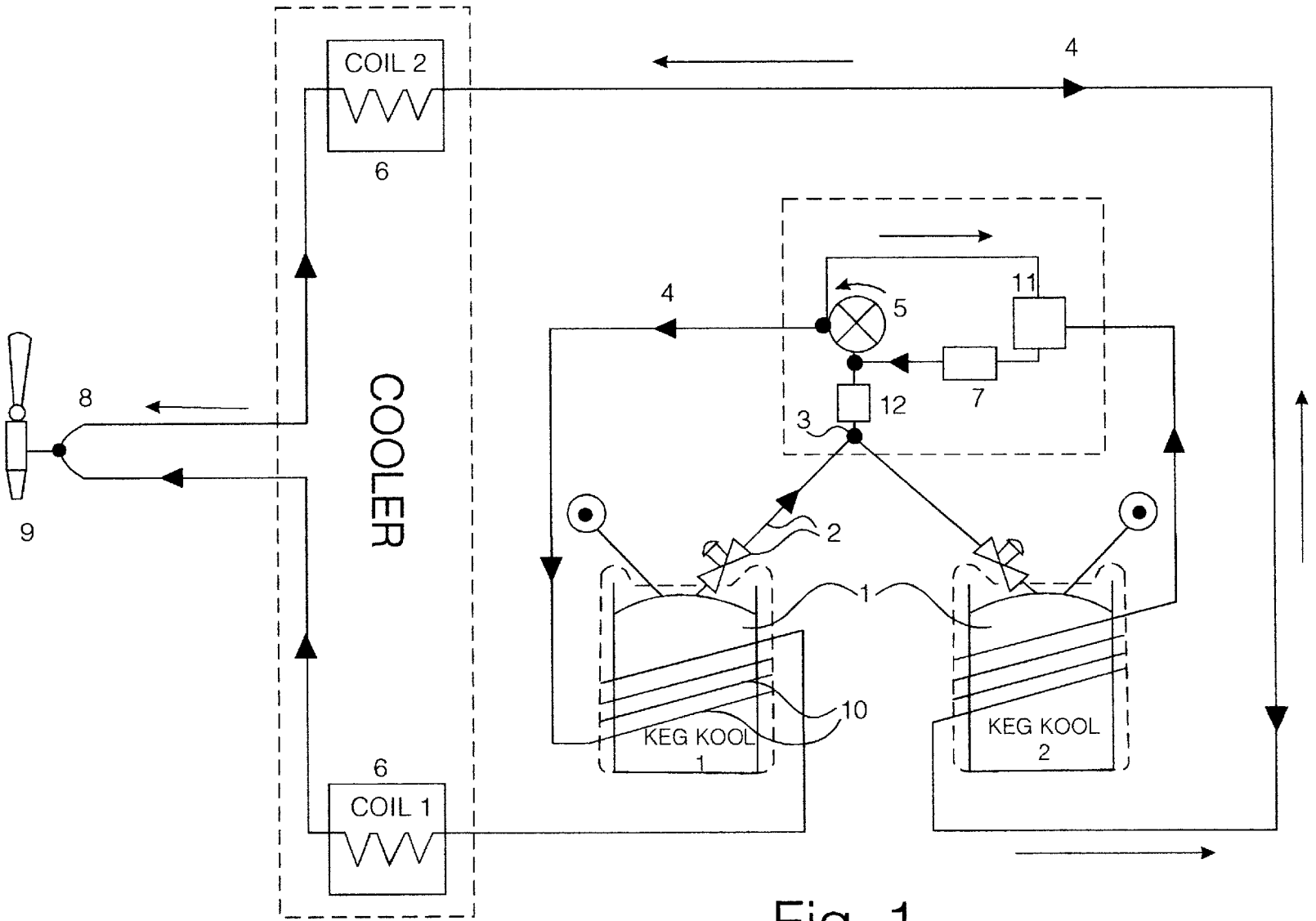

(i) introducing the beverage from a bulk container into a circulation loop that incorporates a pump, and a cooling unit, and (ii) returning cooled beverage as a heat exchange medium to a heat exchange unit associated with the container, whereby the residual beverage in the container is itself cooled by the returning cooled beverage, whereby after a period of time, both the residual beverage in the container and the beverage and the loop are at the same, or generally the same, temperature.

22 Claims, 2 Drawing Sheets

METHOD AND APPARATUS FOR THE COOLING OF BULK OR DRAUGHT BEVERAGES

BACKGROUND OF THE INVENTION

This invention relates to a method and apparatus for the cooling of bulk or draught beverages such as beer, lager, water, soft drinks etc., from a bulk container such as a keg or tank prior to dispensing at a device such as a tap.

BRIEF DESCRIPTION OF THE PRIOR ART

With known dispensing systems comprising a closed loop incorporating a cooling unit and at least one dispensing tap (cf U.S. Pat. No. 4,216,879, WO97/28082), into which loop beverage is fed from a bulk container in accordance with dispensing demand, the rate of dispensing is frequently such that the cooling capacity of the cooling unit is exceeded, and the temperature of the then dispensed beverage rises beyond an optimum, target temperature.

OBJECT OF THE PRESENT INVENTION

An object of the present invention is the provision of an improved method and apparatus for the cooling of bulk or draught beverages to a target dispensing temperature.

SUMMARY OF THE INVENTION

According to a first aspect of the present invention, there is provided a method of cooling bulk or draught beverages prior to dispensing comprising:

(i) introducing the beverage from a bulk container into a circulation loop that incorporates a pump, and a cooling unit, and (ii) returning cooled beverage as a heat exchange medium to a heat exchange unit associated with the container, whereby the residual beverage in the container is itself cooled by the returning cooled beverage.

In this way, after a period of time, both the residual beverage in the container and the beverage and the loop are at the same, or generally the same, temperature.

Thus, with the method in accordance with the invention, the beverage contained in the loop is itself used as the heat exchange medium of the heat exchange unit for cooling the residual beverage within the container. In practice, with say <1-gallon of beverage contained in the loop, the cooling unit, and the heat exchange unit, circulating as a cooling medium, the remaining say 10-gallons in a keg is gradually cooled, e.g. overnight, until an even temperature is attained, when the beverage is ready for dispensing. The temperature of the beverage in the loop, the cooling unit, and the heat exchange unit assists in maintaining the sought lower temperature, as the residual cooled beverage in the keg(s) is effective as a heat sink, being effective on the heat exchange unit and hence assists the cooling action of the cooling unit, thereby increasing the efficiency of the system.

In practice, beverage in a container initially at approximately 12° C., may be reduced over a period of say 24 hours to approximately 4° C.

According to a second aspect of the invention there is provided apparatus for carrying out the method of the first aspect, the apparatus comprising a container for beverage;

a circulation loop supplied by the container;

a pump, a cooling unit and one or more dispensing taps in the loop; and a heat exchange unit to exchange heat between the loop and the container.

In one embodiment, the heat exchange unit may comprise a jacket adapted to fit over a keg. The jacket may of flexible, rigid, or semi-rigid material. The latter may for instance consist of a fibre glass jacket with a foam insert, whereby the heat exchange unit is additionally thermally insulating. A heat exchange coil, e.g. of synthetic plastics tubing, may extend around the inside of the jacket so as to be in close proximity to the external periphery of a keg when the jacket is fitted over the keg.

In another embodiment, the heat exchange unit may comprise a plurality of panels adapted to be assembled together to form an enclosure or cabinet for the bulk container(s).

The control unit may comprise beverage temperature sensing means.

The cooling unit may for instance comprise an ice bank and at least one cooling coil.

Figure 2:
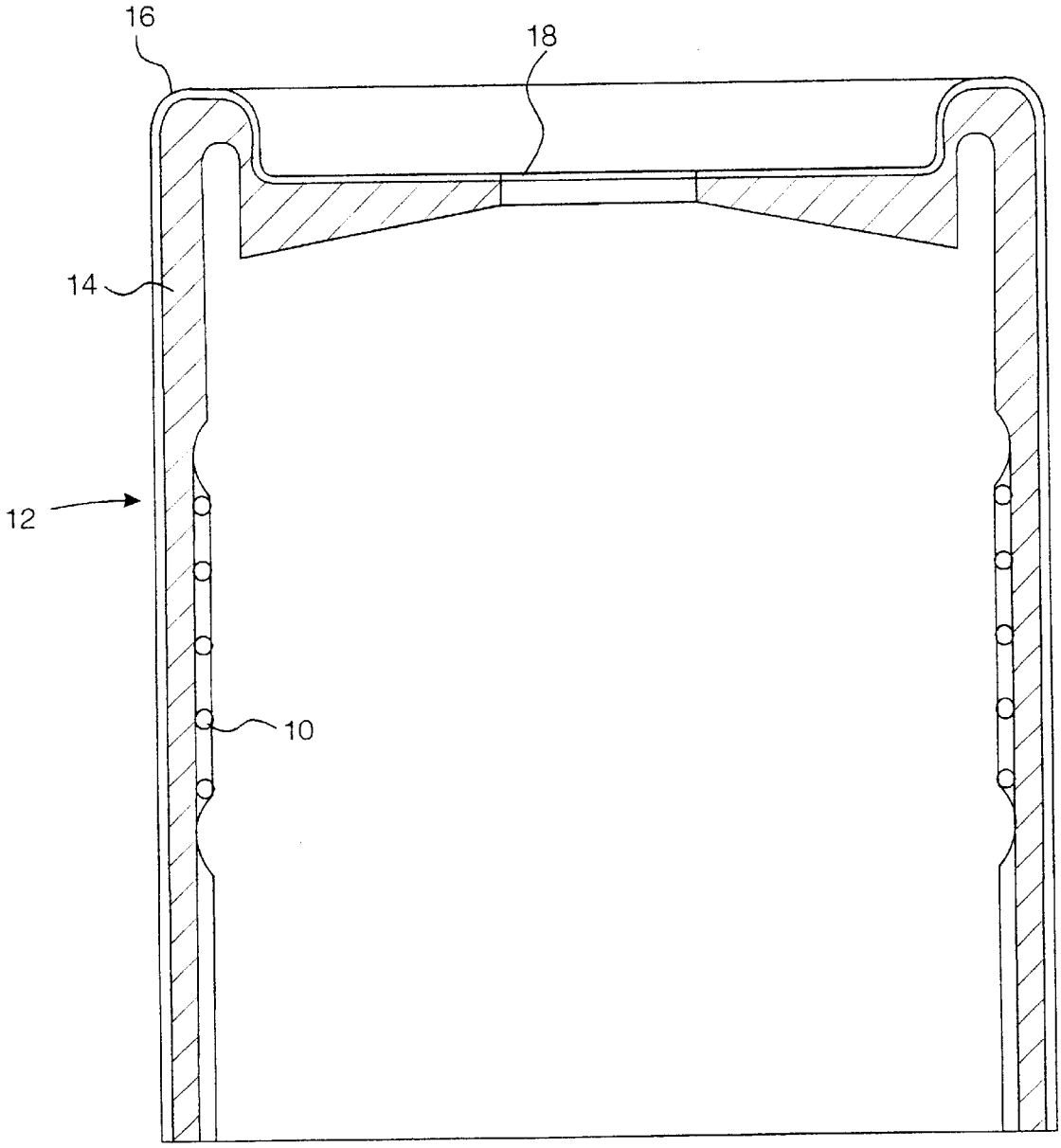

Some aspects of the invention are illustrated diagrammatically, by way of examples, in the accompanying drawings, FIG. 1 being accordance with the first and second aspects, and FIG. 2 details a jacket of a secondary cooling device of FIG. 1.

In FIG. 1, the beverage arrives under pressure from pre-cooled bulk containers 1, entering a controller 12 via a single feed or "Y" piece 3. A flow detection unit 12 controls flow or no flow to an electric pump 5. The flow detection unit 12 can be mounted either on the flow inlet or flow outlet of the pump 5. Providing there are no obstructions and that the loop 4 is full, the pump continues to run unimpeded, circulating beverage continuously around the loop 4. Non-dispensed beverage returns from the bar area also via the loop 4 to the controller 12 entering into a logic valve 11 which recognises whether the dispensing tap(s) 9 is/are open or closed. In the closed condition, beverage arrives at a flow metering device 7 which is adjustable to increase or decrease the speed of circulation. The output from the flow metering device 7 enters the pump 5 to be re-circulated. Should a tap 9 be opened, the logic valve 11 closes the feed to the flow metering device 7, and opens a feed from the pump 5, thus allowing back-flow from the logic valve 11 in the right-hand direction to the dispensing tap(s) 9. This has the benefit of flow equalisation ensuring fresh beverage at each serving passing through both aspects of the cooling unit 6 thus giving minimum dispense temperatures.

The cooling unit 6 comprises two branches, coil 1 and coil 2 one on either side of the dispense taps 9.

In FIG. 2, cooling coils 10 are disposed in a jacket 12, adapted to be fitted over a keg (not shown). The jacket 12 has a skin 16 of plastics and an insulating lining 14, in which the coils 10 are retained. A central opening 18 permits access to the keg for attachment of a pipeline 2 and associated valve. The jacket 12 is open at its base to facilitate fitting on a keg.

What is claimed is:

1. A method of cooling beverage prior to dispensing comprising:

(i) introducing the beverage from a container into a circulation loop that incorporates a pump and a cooling unit, and (ii) returning cooled beverage as a heat exchange medium to a heat exchange unit associated with the container, whereby residual beverage in the container is itself cooled by the returning cooled beverage.

2. Beverage dispensing apparatus for carrying out the method of claim 1 comprising, a container for beverage;

a circulation loop supplied by the container;

a pump, a cooling unit and one or more dispensing taps in the loop; and a heat exchange unit to exchange heat between the loop and the container.

3. Apparatus as claimed in claim 2 wherein the heat exchange unit comprises a jacket adapted to fit over a keg.

4. Apparatus as claimed in claim 3 wherein said jacket is of flexible material.

5. Apparatus as claimed in claim 3 wherein said jacket is of rigid or semi-rigid material.

6. Apparatus as claimed in claim 5 wherein said jacket comprises a fibre glass jacket with a foam insert, whereby the heat exchange unit is additionally thermally insulating.

7. Apparatus as claimed in any of claim 3 wherein a heat exchange coil extends around the inside of said jacket so as to be in close proximity to the external periphery of a keg when the jacket is fitted over the keg.

8. Apparatus as claimed in claim 2 wherein the heat exchange unit comprises a plurality of panels adapted to be assembled together to form an enclosure or cabinet for the bulk container(s).

9. Apparatus as claimed in any of claim 2 wherein said control unit includes beverage temperature sensing means.

10. Apparatus as claimed in any of claim 2 wherein said cooling unit comprises an ice bank and at least one cooling coil.

11. Apparatus as claims in claim 4 wherein a heat exchange coil extends around the inside of said jacket so as to be in close proximity to the external periphery of a keg when the jacket is fitted over the keg.

12. Apparatus as claims in claim 5 wherein a heat exchange coil extends around the inside of said jacket so as to be in close proximity to the external periphery of a keg when the jacket is fitted over the keg.

13. Apparatus as claims in claim 6 wherein a heat exchange coil extends around the inside of said jacket so as to be in close proximity to the external periphery of a keg when the jacket is fitted over the keg.

14. Apparatus as claimed in claim 3 wherein said control unit includes beverage temperature sensing means.

15. Apparatus as claimed in claim 4 wherein said control unit includes beverage temperature sensing means.

16. Apparatus as claimed in claim 5 wherein said control unit includes beverage temperature sensing means.

17. Apparatus as claimed in claim 6 wherein said control unit includes beverage temperature sensing means.

18. Apparatus as claimed in claim 7 wherein said control unit includes beverage temperature sensing means.

19. Apparatus as claimed in claim 8 wherein said control unit includes beverage temperature sensing means.

20. Apparatus as claim in claim 11 wherein said control unit includes beverage temperature sensing means.

21. Apparatus as claimed in claim 12 wherein said control unit includes beverage temperature sensing means.

22. Apparatus as claimed in claim 13 wherein said control unit includes beverae temperature sensing means.

* * * * *